US006062898A

United States Patent [19]

Bortoloni

[11] Patent Number: 6,062,898

[45] Date of Patent: May 16, 2000

[54] ELECTRIC CONNECTOR FOR FLEXIBLE CIRCUITS

[75] Inventor: Roberto Bortoloni, Settimo Torinese, Italy

[73] Assignee: Framatome Connectors International S.A., Courbevoie, France

[21] Appl. No.: 09/142,009

[22] PCT Filed: Mar. 4, 1997

[86] PCT No.: PCT/EP97/01087

§ 371 Date: Oct. 29, 1998

§ 102(e) Date: Oct. 29, 1998

[87] PCT Pub. No.: WO97/33343

PCT Pub. Date: Dec. 9, 1997

[30] Foreign Application Priority Data

Mar. 5, 1996 [IT] Italy ..... T096A0163

[51] Int. Cl.[7] ..... H01R 4/24; H01R 4/26

[52] U.S. Cl. ..... 439/427

[58] Field of Search ..... 439/427, 387, 439/495, 496, 389, 426, 260

[56] References Cited

U.S. PATENT DOCUMENTS

| | | | |
|---|---|---|---|
| 3,407,378 | 10/1968 | Siders et al. | 339/176 |
| 3,633,152 | 1/1972 | Podmore | 339/91 R |
| 3,786,173 | 1/1974 | Vogt | 174/88 S |
| 3,861,772 | 1/1975 | Shaffer | 339/99 R |
| 4,118,096 | 10/1978 | Takahashi | 339/97 R |
| 4,367,004 | 1/1983 | Fujiura et al. | 339/97 R |
| 4,512,619 | 4/1985 | Dechelette | 339/94 M |
| 4,891,018 | 1/1990 | Afflerbaugh et al. | 439/402 |
| 5,221,213 | 6/1993 | Lee | 439/125 |
| 5,655,929 | 8/1997 | Sawada | 439/559 |
| 5,707,257 | 1/1998 | Kotajima et al. | 439/762 |

FOREIGN PATENT DOCUMENTS

| | | |
|---|---|---|
| 0014037 | 8/1980 | European Pat. Off. . |
| 0347100 | 12/1989 | European Pat. Off. . |

OTHER PUBLICATIONS

PCT International Search Report.

*Primary Examiner*—Steven L. Stephan
*Assistant Examiner*—Chandrika Prasad
*Attorney, Agent, or Firm*—Perman & Green, LLP

[57] ABSTRACT

An electrical connector for a flexible circuit comprising a number of side by side conducting tracks between a pair of insulating layers; an insulating casing with an inner end seat for receiving one end of the flexible circuit; a number of electrical terminals housed inside the casing and presenting contact portions cooperating with respective tracks of the flexible circuit by slitting the insulating layers; and a safety element, which snaps inside the seat and presents walls for gripping the contact portions of the terminals onto the flexible circuit.

12 Claims, 3 Drawing Sheets

FIG. 1.
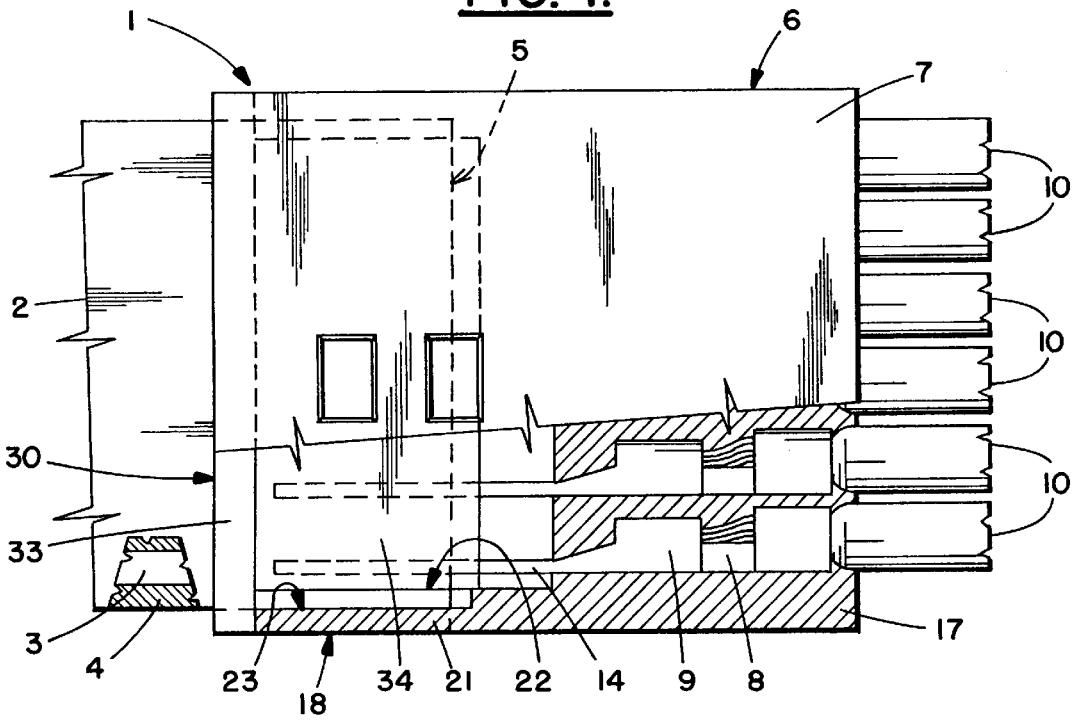
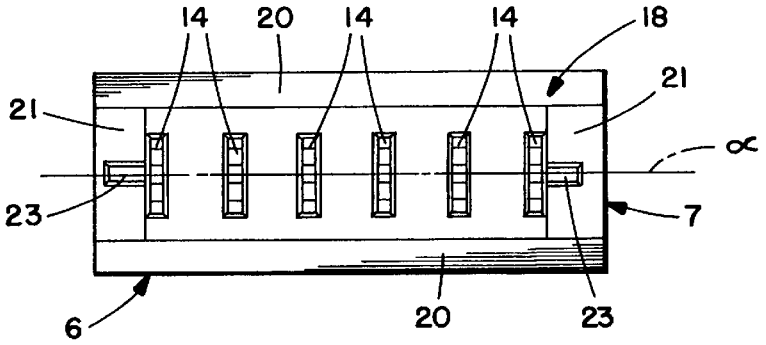
FIG. 2.
FIG. 3.
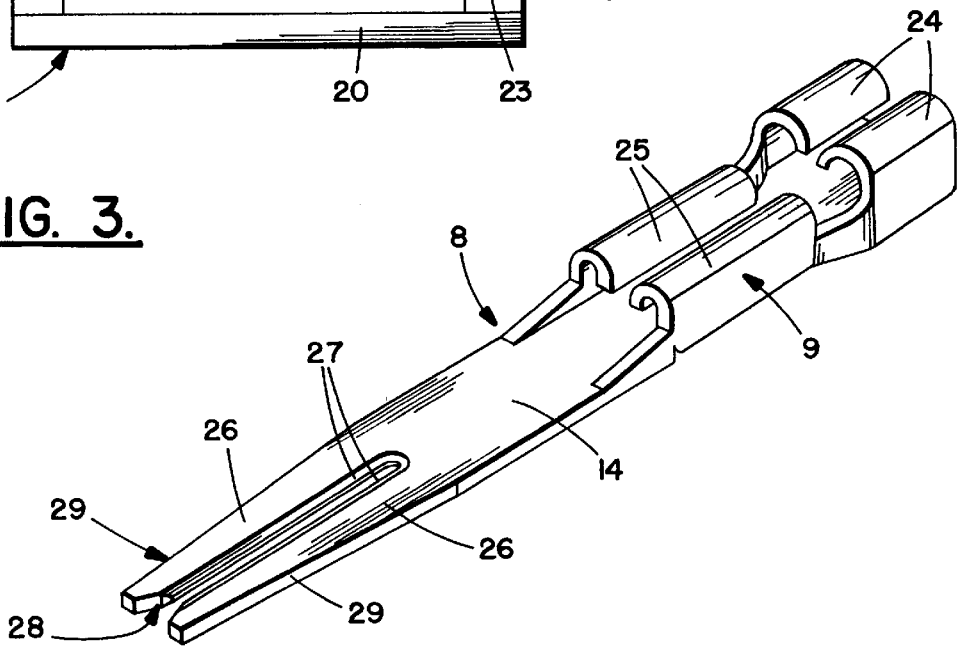

ELECTRIC CONNECTOR FOR FLEXIBLE CIRCUITS

TECHNICAL FIELD

The present invention relates to an electric connector for a flexible electric circuit of the type comprising one or more conducting tracks covered with insulating layers.

BACKGROUND ART

Normally, for connection to another electric circuit, the conducting tracks of a flexible circuit must first be exposed by locally removing the insulating layers.

In some cases, the cables of the other electric circuit are bonded directly to the locally exposed tracks; in others, particularly when the other electric circuit is a printed circuit board, a connector is used presenting a number of terminals cooperating with the exposed portions of the tracks (normally in forced manner to ensure adequate contact pressure) and presenting contact portions for connection to respective conducting elements of the other electric circuit.

Removing the insulating layer from the tracks of the flexible circuit is a painstaking preliminary operation, which therefore increases work time and cost.

DISCLOSURE OF INVENTION

It is an object of the present invention to provide an electric connector for a flexible circuit, enabling the above preliminary operation to be dispensed with, and which provides for rapid, effective, reliable connection of a flexible circuit to another electric circuit.

According to the present invention, there is provided an electric connector for a flexible circuit presenting at least one conducting track and a cover layer of insulating material; the connector comprising an insulating casing, and at least one electric terminal housed in said casing and presenting a respective contact portion cooperating with said conducting path; characterized in that said contact portion of said terminal comprises slitting means for slitting said cover layer.

BRIEF DESCRIPTION OF THE DRAWINGS

A preferred, non-limiting embodiment of the present invention will be described by way of example with reference to the accompanying drawings, in which:

FIG. 1 shows a partly sectioned plan view of a connector in accordance with the teachings of the present invention;

FIG. 2 shows a front view of the main body of the FIG. 1 connector;

FIG. 3 shows a view in perspective of an electric terminal of the FIG. 1 connector;

BEST MODE FOR CARRYING OUT THE INVENTION

Number 1 in FIG. 1 indicates a connector for a flexible electric circuit 2.

Figure 5:
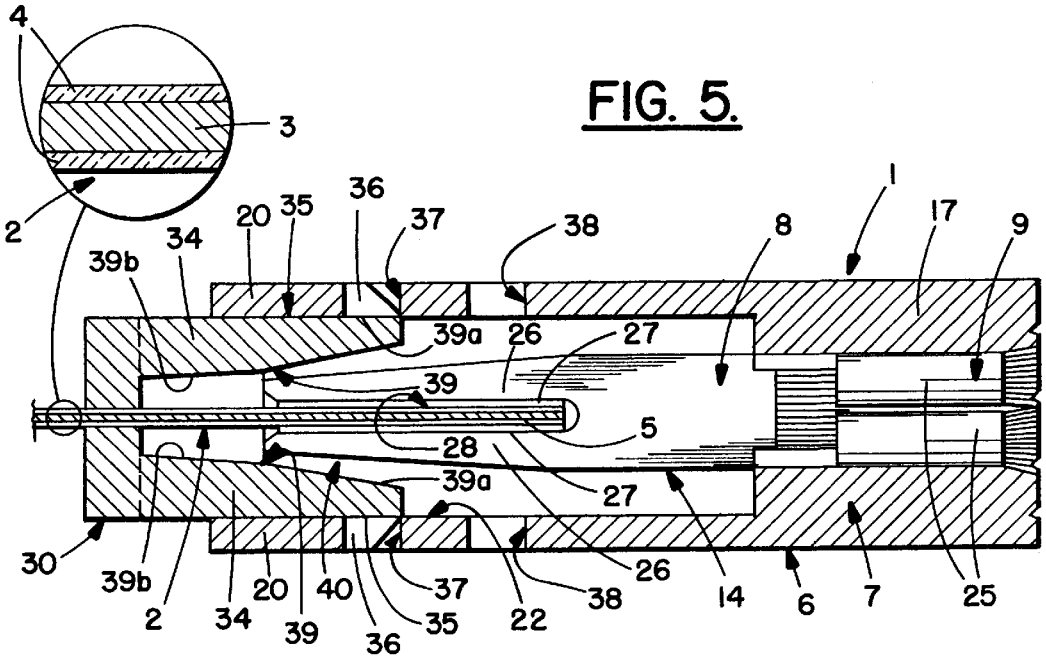
FIG. 5 shows a larger-scale partial longitudinal section of the FIG. 1 connector in the preassembly position.

In known manner, flexible circuit 2 is in the form of an elongated strip, and comprises a number of side by side conducting tracks 3 (only one shown) extending lengthwise of the strip, sandwiched between two layers 4 of insulating material (FIG. 5), and terminating at a free end edge 5 of circuit 2, perpendicular to tracks 3.

Connector 1 comprises a main body 6 in turn comprising a casing 7 of plastic insulating material, and a number of electric terminals 8 housed inside and partly co-molded into casing 7.

More specifically, each terminal 8 presents a connecting portion 9 for connection to a respective electric cable 10; and a contact portion 14 cooperating with circuit 2. Casing 7 is substantially parallelepiped, and comprises a rear portion 17 incorporating portions 9 of terminals 8 and the respective end portions of cables 10; and a hollow front portion 18 defined by a pair of base walls 20 and a pair of lateral walls 21 defining a seat or cavity 22 into which contact portions 14 of terminals 8 project parallel to tracks 3 of circuit 2. Lateral walls 21 present respective central longitudinal grooves 23, which are engaged by respective lateral edges of circuit 2 to define the seating plane a of circuit 2 inside seat 22.

Portion 9 of each terminal 8 comprises, in known manner, two pairs of clamps 24, 25 for respectively gripping the insulating sheath and a bear end portion of respective cable 10.

Contact portion 14 of each terminal 8 presents a pair of elongated coplanar blades 26 perpendicular to plane $\alpha$, and in turn presenting respective cutting edges 27 facing each other and defining an opening 28 narrower than the thickness of conducting tracks 3 of circuit 2, so that, when circuit 2 is inserted between blades 26 along plane $\alpha$, insulating layers 4 are slit and blades 26 establish electric contact with respective conducting track 3.

Blades 26 present respective longitudinal edges 29 on the opposite side to respective edges 27, facing respective base walls 20, and inclined wedge-fashion so that blades 26 taper gradually towards the free end.

Figure 4:
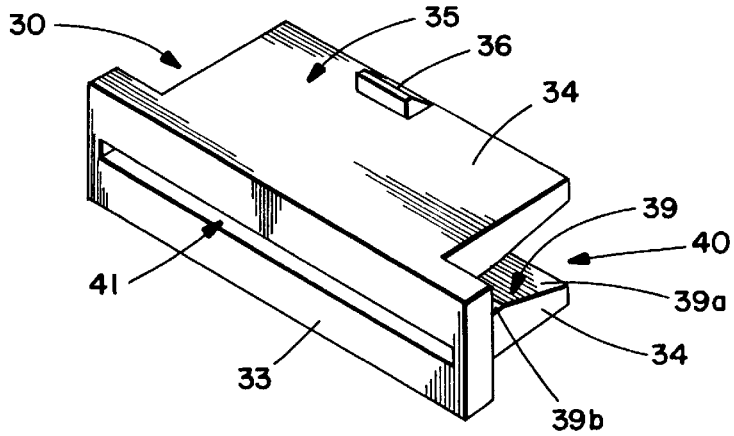
FIG. 4 shows a view in perspective of a safety element of the FIG. 1 connector.

Connector 1 also comprises a retaining element or safety element 30 (FIG. 4), which snaps inside seat 22 of front portion 18 of casing 7 to ensure, in use, stable, reliable engagement of circuit 2 by blades 26.

Figure 6:
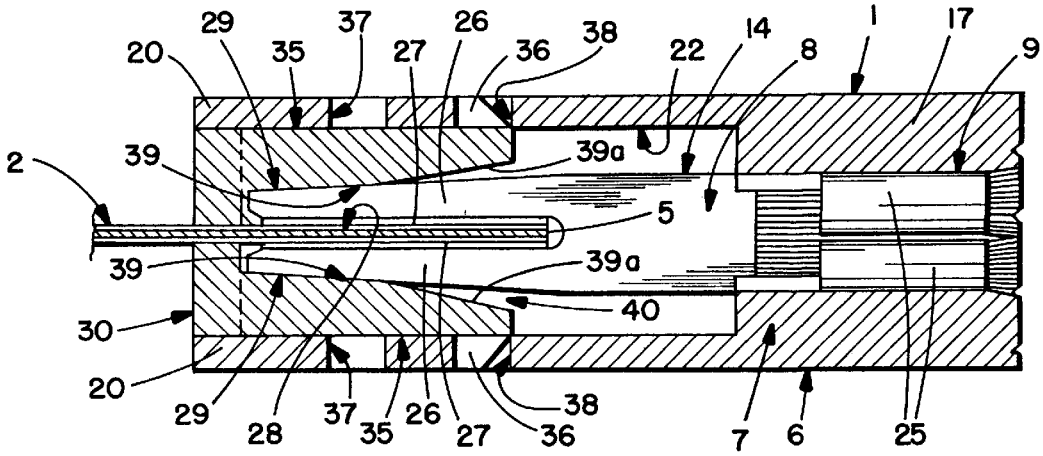
FIG. 6 shows a larger-scale partial longitudinal section of the FIG. 1 connector in the assembly position.

Retaining element 30 substantially comprises an elongated rectangular plate 33; and a pair of walls 34 projecting perpendicularly from opposite longitudinal edges of plate 33. Walls 34 are defined externally by respective flat surfaces 35 parallel to each other and which slide along respective inner surfaces of base walls 20 of portion 18 of casing 7. Close to its free end, each wall 34 presents a retaining tooth 36 projecting from surface 35 and which snaps inside respective seats 37, 38 formed in respective base wall 20. Each wall 20 conveniently comprises a pair of seats 37, 38, the first closer than the second to the inlet of seat 22, and which cooperate with respective tooth 36 to respectively define a preassembly position (FIG. 5) and an assembly position (FIG. 6) of retaining element 30.

Walls 34 present respective inner surfaces 39 shaped to define a cavity 40 tapering towards plate 33. More specifically, surfaces 39 present respective inlet portions 39*a* forming an angle greater than that formed by edges 29 of blades 26; and respective seating portions 39*b* forming an angle substantially equal to that formed by edges 29 of blades 26.

Plate 33 presents a central longitudinal through opening 41 through which circuit 2 is fitted.

Connector 1 operates as follows.

Circuit 2 is first inserted through opening 41 in plate 33 of retaining element 30, and is then inserted inside cavity 22, conveniently by means of a tool (not shown), so that the lateral edges of circuit 2 engage grooves 23, end edge 5 penetrates between blades 26 of each terminal 8, insulating layers 4 are slit, and each terminal 8 establishes electric contact with respective conducting track 3.

At this point, retaining element 30 is connected to casing 7 in a preassembly position (FIG. 5) defined by the engagement of seats 37 by teeth 36, and wherein blades 26 loosely engage the inlet portion of cavity 40 defined by portions 39*a;* and retaining element 30 is then pushed further into an assembly position (FIG. 6) defined by the engagement of seats 38 by teeth 36, and wherein blades 26 engage the end portion of cavity 40, and cooperate with and are compressed slightly by portions 39*b* of surfaces 39 to ensure, in use, takeup of the slack between blades 26 and conducting tracks 3.

Figure 7:
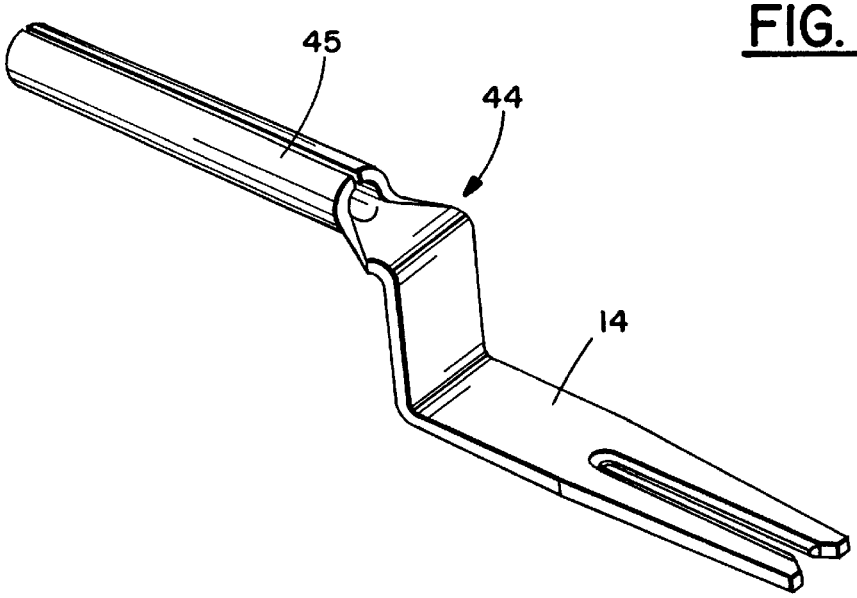
FIG. 7 shows a first variation of an electric terminal of the FIG. 1 connector.
Figure 8:
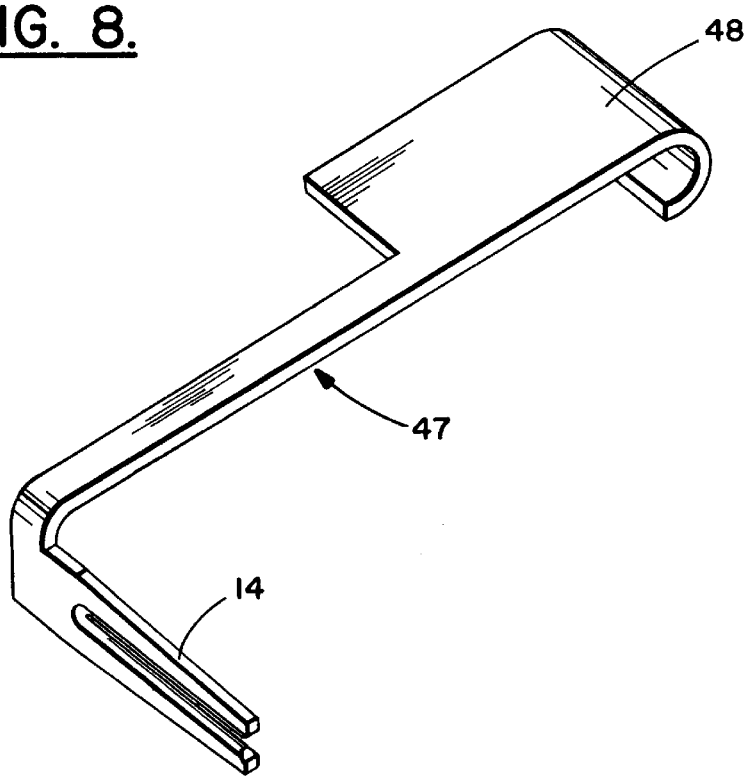
FIG. 8 shows a second variation of an electric terminal of the FIG. 1 connector.

FIGS. 7 and 8 show electric terminals for connector 1 according to variations of the present invention.

More specifically, FIG. 7 shows a terminal 44 presenting a contact portion 14 identical to that of terminal 8 described, but presenting a cylindrical pin contact 45 in place of portion 9. In this case, casing 7 (not shown) conveniently presents a cavity, opposite seat 22, for receiving a complementary electric connector presenting female terminals mating with contacts 45.

FIG. 8 shows a terminal 47 presenting, in place of portion 9, a shaped contact blade 48, which extends laterally outside casing 7 to form an auxiliary, e.g. ground, contact with a corresponding conducting portion provided in the housing of the connector.

The advantages of electric connector 1 according to the present invention will be clear from the foregoing description.

In particular, connector 1 provides for rapid, effective, reliable connection to flexible circuit 2, with no need to remove the insulating layer.

Clearly, changes may be made to connector 1 as described and illustrated herein without, however, departing from the scope of the present invention.

I claim:

1. An electric connector (1) for a flexible circuit (2) presenting at least one conducting track (3) and a cover layer (4) of insulating material; the connector (1) comprising an insulating casing (7), and at least one electric terminal (8) housed in said casing (7) and presenting a respective contact portion (14) cooperating with said conducting path (3); characterized in that said contact portion (14) of said terminal (8) comprises slitting means (26) for slitting said cover layer (4), wherein said casing (7) presents a cavity (22) for a free end of said flexible circuit (2); said contact portion (14) of said terminal extending inside said cavity (22) in a direction parallel to said conducting track(3).

2. A connector as claimed in claim 1, characterized by comprising a movable retaining element (30), which snaps inside said cavity (22) and presents gripping means (34) for gripping said contact portion (14) of said terminal (8) onto said flexible circuit (2).

3. A connector as claimed in claim 1, characterized in that said flexible circuit (2) comprises a pair of insulating cover layers (4) on either side of said conducting track (3).

4. A connector as claimed in claim 3, characterized in that said contact portion (14) comprises a pair of blades (26) lying in a plane perpendicular to the plane ($\alpha$) of said flexible circuit (2) and forming an opening (28) of a width at most equal to the thickness of said conducting track (3).

5. A connector as claimed in claim 4, characterized in that said safety element (30) presents a through opening (41) for said flexible circuit (2).

6. A connector as claimed in claim 4, characterized in that said gripping means comprise a pair of walls (34) on said said safety element (30) and interacting with said blades (26) of said terminal (8).

7. A connector as claimed in claim 6, characterized in that said walls (34) present respective surfaces (39) facing each other and so inclined as to define a cavity (40) for said blades (26) tapering towards one end of the blades (26); said blades (26) presenting respective opposite edges (29) inclined in the same way as said surfaces (39) and cooperating with said surfaces (39) in an assembly position of said safety element (30).

8. A connector as claimed in claim 1, characterized in that said terminal (8) comprises a connecting portion (9) for connection to an electric cable (10).

9. A connector as claimed in claim 1, characterized in that said terminal comprises a connecting portion (45) for connection to a complementary electric terminal.

10. A connector as claimed in claim 1, characterized in that said terminal comprises an auxiliary contact portion (48) extending outside said casing (7).

11. A connector as claimed in claim 1, characterized in that said flexible circuit (2) comprises a number of parallel conducting tracks (3); said connector (1) comprising a number of side by side electric terminals (8), each cooperating with a respective said conducting track (3).

12. A connector as claimed in claim 11, characterized in that said electric terminals (8) are partly co-molded into said casing (7).

* * * * *